United States Patent [19]

Edwards

[11] 4,361,306

[45] Nov. 30, 1982

[54] HOT TOP BOARD, METHOD OF FASTENING TO INGOT MOLD, AND RESULTING ASSEMBLY

[75] Inventor: Robert F. Edwards, Hamilton, Canada

[73] Assignee: Pneutek, Inc., Hudson, N.H.

[21] Appl. No.: 237,747

[22] Filed: Feb. 24, 1981

Related U.S. Application Data

[63] Continuation-in-part of Ser. No. 107,288, Dec. 26, 1979, abandoned.

[51] Int. Cl.[3] ..... B22D 7/10

[52] U.S. Cl. ..... 249/106; 29/432; 29/526 R; 164/1; 249/198

[58] Field of Search ..... 164/1, 137; 249/197–202, 106, DIG. 5; 29/526 R, 432

[56] References Cited

U.S. PATENT DOCUMENTS

| | | | |
|---|---|---|---|
| 3,002,238 | 10/1961 | Orrison | 249/202 X |
| 3,436,883 | 4/1969 | Charman, Jr. et al. | 164/137 X |
| 3,722,848 | 3/1973 | Young | 249/202 X |
| 4,078,296 | 3/1978 | Willard et al. | 164/137 X |

FOREIGN PATENT DOCUMENTS

| | | | |
|---|---|---|---|
| 1261633 | 2/1968 | Fed. Rep. of Germany | 249/202 |
| 47-24851 | 7/1972 | Japan | 249/197 |
| 197025 | 7/1965 | Sweden | 164/137 |

*Primary Examiner*—R. L. Spruill
*Assistant Examiner*—J. Reed Batten, Jr.
*Attorney, Agent, or Firm*—Schiller & Pandiscio

[57] ABSTRACT

In a hot top mounting method for mounting hot top insulation boards to the inside upper surface of a metal ingot mold, a plurality of spaced parallel metal straps are first affixed to a surface of each board, and each board is then fastened to the mold inner wall by setting a plurality of headed fasteners through the strap and into the mold wall using an air operated, magazine-type fastener driving tool. The straps are preferably of channel cross-section which then act as guides to locate the tool for the fastening operation. The channel straps when disposed vertically can have a row of spaced apertures in one edge which selectively receive a U-shaped hanger for suspending the board from the mold top edge for the fastening operation, the hanger being removed once fastening is complete. The straps can be disposed in other orientations such as horizontal depending upon the fastening pattern required. The tool is provided with an elongated handle to permit it to be used down in the mold from above the mold.

19 Claims, 3 Drawing Figures

HOT TOP BOARD, METHOD OF FASTENING TO INGOT MOLD, AND RESULTING ASSEMBLY

This application is a continuation-in-part of my copending Application Ser. No. 107,288, filed Dec. 26, 1979 and now abandoned.

FIELD OF THE INVENTION

This invention is concerned with mounting methods for mold hot top sideboards employed with open-topped metal ingot molds, and mounting elements for use in such methods.

REVIEW OF THE PRIOR ART

Hot top side boards are now almost always used to line the upper inner portion of open-topped metal ingot molds for the purpose of delaying the solidification of the adjacent metal and inhibiting the formation of voids and cavities in the resultant metal ingot. The boards usually are suspended within the mold prior to pouring by some suitable method, but since the board material normally used is less dense than molten steel, they must be prevented in some way from floating as they become immersed therein. One method used hitherto is to nail the boards directly to the inner wall of the mold. In this method a plurality of headed nails each inserted in a respective metal washer are driven home through the board and into the mold wall in a predetermined spaced pattern by an explosive-activated gun. Such guns are essentially single-shot and there is a substantial danger of the nail cracking the board as it is driven home. Moreover, it will be appreciated that the working conditions for the operator are arduous, involving operating a heavy gun with the requirement to drive the nails accurately in the predetermined pattern, while above and close to a hot massive metal mold.

Another problem encountered with this prior art method is that it is not completely effective in preventing "floaters" i.e. the above-described floating of the boards. This is usually found to be due to the fact that the washers have been driven a considerable distance into the board and are spaced from the nail heads and the forces to which the board is subjected by the cooling metal are sufficiently strong that the resultant agitation frees the washers from the nails, allowing the boards to float free.

A prior novelty search carried out in Class 249 (Static Molds), Sub-Classes 198 (Means permitting change in relative position of hot top on mold) and 202 (adjuncts) did not reveal any patent pertinent to this invention and U.S. Pat. Nos. 3,506,236; 3,797,801; 3,966,167 and 4,083,528 are referred to as being of interest only.

DEFINITION OF THE INVENTION

It is therefore an object of the present invention to provide a new method for mounting mold hot top side boards to the upper inner surface of an open-topped metal ingot mold.

It is also an object to provide new mounting elements for use in such a mounting method.

In accordance with the present invention there is provided a method for mounting hot top boards to the top interior of a metal ingot mold comprising:

affixing to a surface of a hot top board that is to be an internal surface of the hot top at least one elongated metal strap element;

suspending the hot top board inside the top interior of the mold; and fastening the hot top board to the mold interior surface by fasteners driven through the said elongated metal strap element to constitute an extended metal washer therefor.

Also in accordance with the invention there is provided a hot top board element for lining the top interior of a metal ingot mold comprising a board of hot top material having at least one metal strap element affixed to one surface thereof at spaced intervals and constituting an extended metal washer for the reception of fasteners for fastening the boards to the mold interior wall.

Further in accordance with the invention there is provided a hot top board element for a hot top board for lining the top interior of a metal ingot mold comprising:

a board of hot top material, at least one elongated strap element of channel cross-section affixed to the board with its base in contact with the board surface and its sides protruding therefrom, the element being disposed vertically and having in one vertical side thereof a plurality of longitudinally spaced apertures, and a hanger element having one end turned for selective removable engagement in one of the said apertures, and another part thereof engageable with the top end of the mold for retention thereon.

DESCRIPTION OF DRAWINGS

Mounting methods and elements for such methods that are particular preferred embodiments of the invention will now be described, by way of example, with reference to the accompanying diagrammatic drawings, wherein.

DESCRIPTION OF THE PREFERRED EMBODIMENTS

Figure 1:
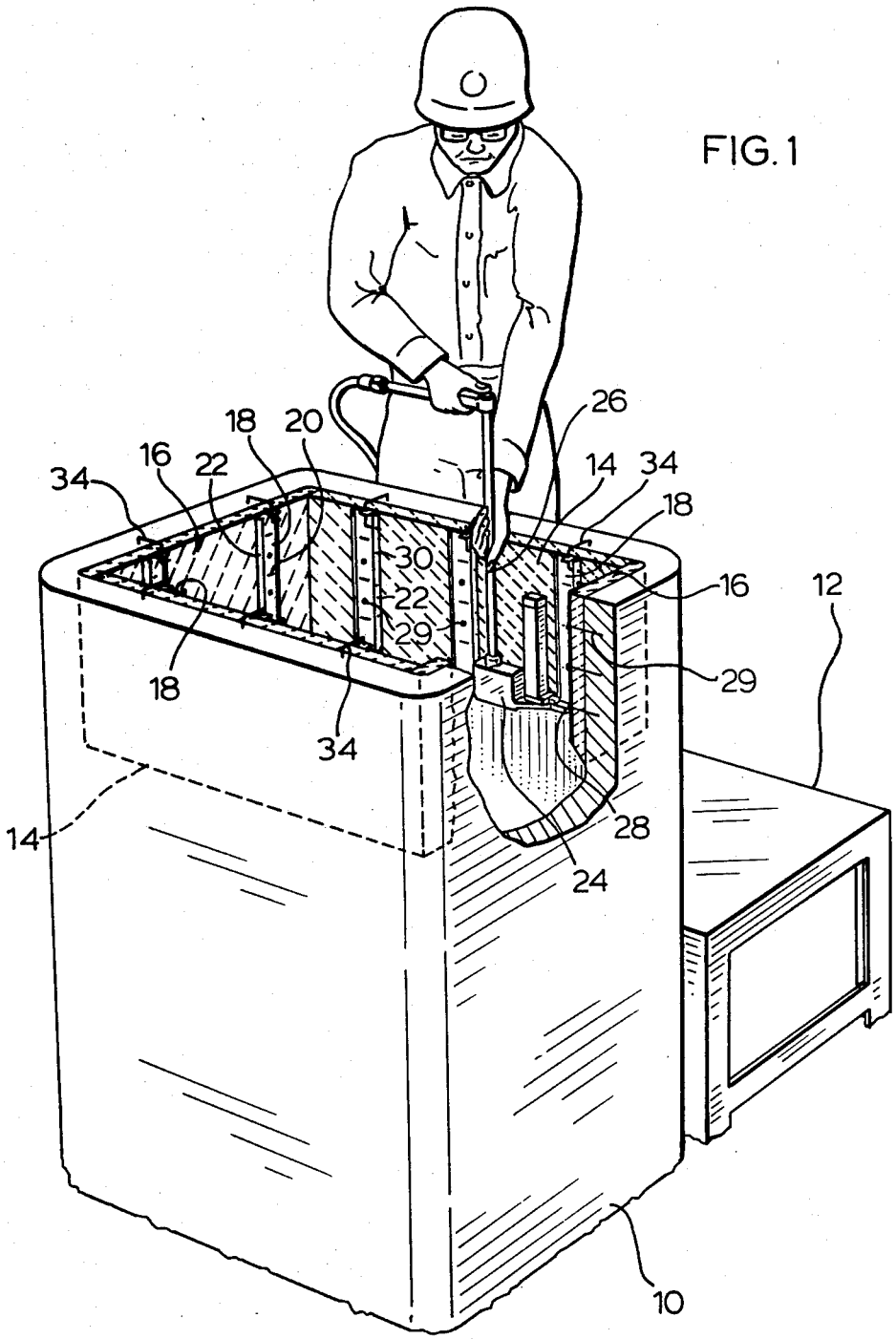
FIG. 1 is a perspective view of the top of a mold, part of one wall being shown broken away, illustrating the method and hot top board element in accordance with the invention.

An open-topped metal ingot mold is given the reference 10 and is disposed adjacent a platform 12 from which an operator can gain the necessary access to the upper inner portion of the mold. It is also possible for the operator to operate the method while standing on the mold upper edge. Such molds are almost invariably of rectangular transverse cross-section and the upper open end is lined with two rectangular longer hot top side boards 14 and two rectangular shorter side boards 16 disposed a predetermined distance from the mold top edge in dependence upon the length of the ingot that is to be cast in the mold. Alternatively, in sufficiently small molds the shorter side boards 16 may be omitted entirely and only the two longer side boards 14 will be attached to the mold. A suspension system for attaching the hot top side boards to the mold will be described below.

In the particular embodiment illustrated each longer side board 14 is provided with three spaced parallel vertically disposed steel strap elements 18, affixed as by spaced metal staples 20 to the board, while the shorter side boards 16 are provided with two such straps. The number of straps to be provided depends of course upon the width dimension of the board to which they are fastened. In commercial practice ingot molds may vary from about 80 cm to about 160 cm in width (boards 14) and from about 50 cm to about 60 cm in depth (boards 16) and with a wide shallow mold side boards 16 may not be used. Each strap element 18 is of channel cross-section disposed with the base of the channel in contact with the inner face of the board and with its protruding side edges 22 inclined inwardly toward each other, e.g. by a roll-forming operation performed on a continuous strip from which the elements are severed. The channel acts as a guideway and transverse locator for an air-operated, magazine-type fastener driving tool 24 provided with an elongated handle 26, so that it can be used down in the mold by an operator standing on the platform 12. Thus, the operator need only engage the nose 28 of the tool between the channel side walls with the certainty that upon its operation each fastener 29 will be driven through the channel base. The channel base also serves as a highly-effective extended metal washer of many times the surface area of a corresponding conventional washer, reducing the possibility of board cracking and the so-called "floaters". The operator therefore need concern himself only with holding the tool at the right height relative to the board, and pressing the actuating trigger. The tool magazine typically holds more fasteners than are required for the hot top lining of a single mold, and the attachment of a set of four boards to the mold walls can usually be carried out in about 20 seconds, as compared with 70 seconds required for the above-described procedure using an explosive-operated tool and separate fasteners and washers.

The straps also perform another highly useful function in that the refractory type materials used for the boards tend to be somewhat brittle, and the straps act as a reinforcing means to help prevent breakage and cracking during transport, handling and installation, as well as during the driving of the nails. A strap of channel section besides acting as a guide for the nailing tool, is more rigid than a flat strap of the same thickness, permitting a thinner material to be used. A typical strap will be of 24 gauge steel (0.60 mm thickness) rolled from a strip of about 5 cm width to have an effective width of about 3 cm. The channel sides preferably are inclined inwards toward each other at angles of about 30° to 60° to the base to provide the desired rigidity, and also to give a narrower guide channel for the fastener driving tool. Because of the guidance provided by the channel-shaped straps 18 the handle of the tool can be comparatively very long, e.g. from about 75 cm to 150 cm, to permit the operator to reach it into the mold from above while holding it securely and accurately in the desired position for driving home the fasteners from its magazine.

In other embodiments the channel straps 18 may be disposed horizontally, although a cost analysis shows that such a system uses more steel strap than the vertical embodiment described above; in such case the vertical position to the tool is located automatically by the channel-shaped strap elements and the operator need only concern himself with the horizontal positioning of the tool before firing the fastener. Other arrangements which are combinations of both horizontal and vertical strap elements are of course possible depending upon the preference of the user, and perhaps the need to vary the pattern as the mold walls become perforated with nail holes.

Figure 2:
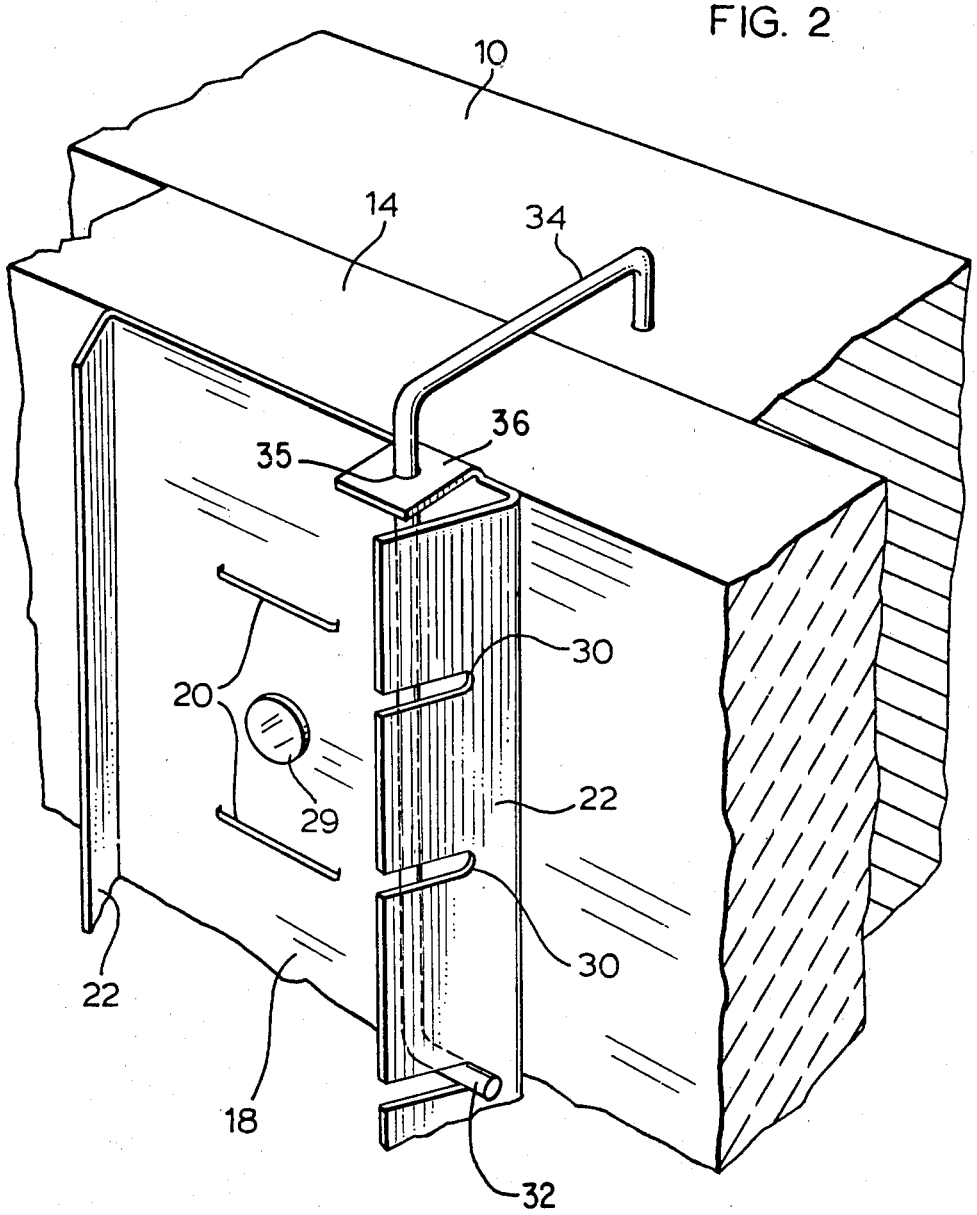
FIG. 2 shows a portion of the mold wall and the attached hot top board element drawn to a considerably larger scale.
Figure 3:
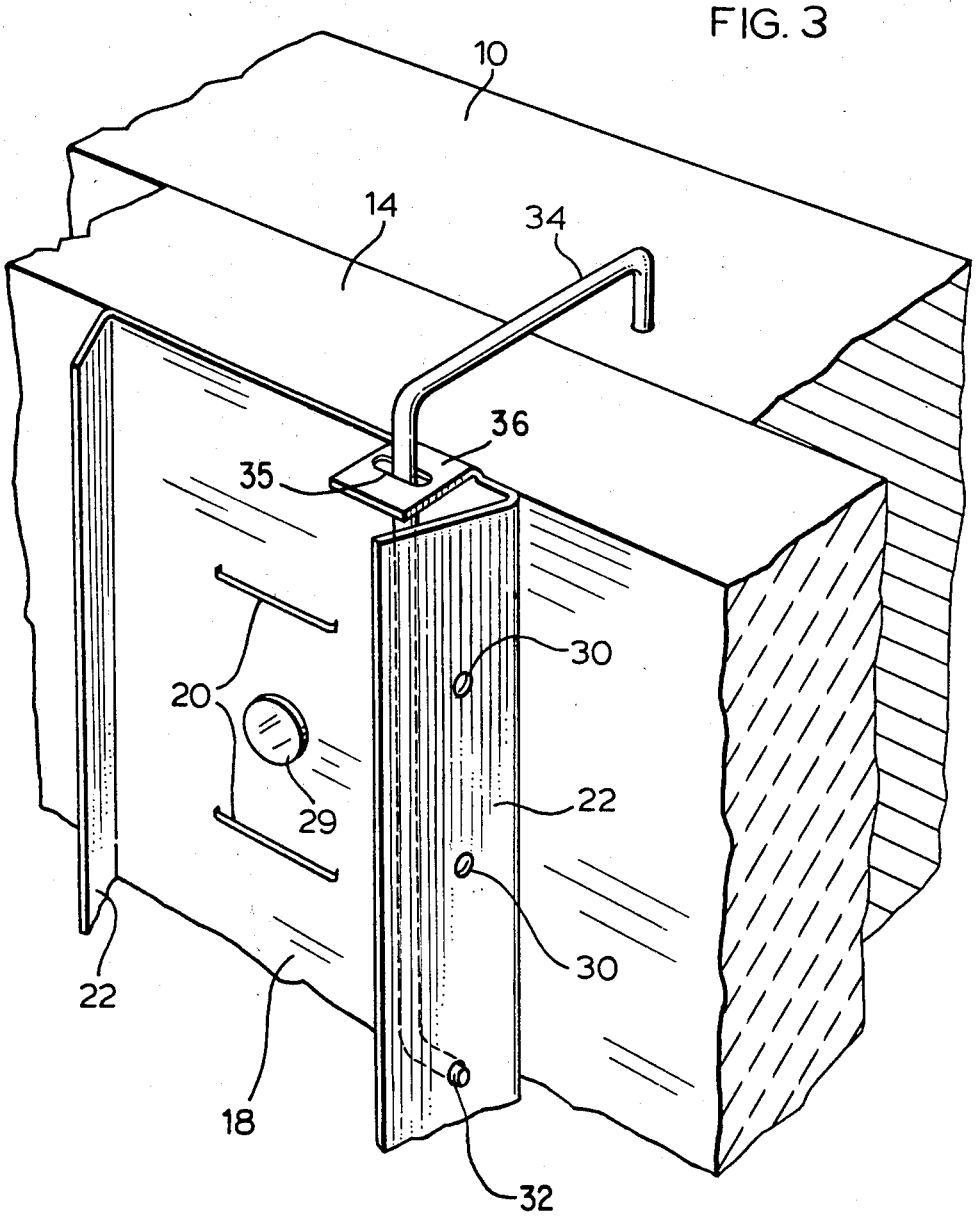
FIG. 3 is a view like that of FIG. 2, except that it shows a second embodiment of the present invention.

The channel strap elements of the invention also permit the provision of a simple, effective and inexpensive method for suspending the boards in the mold prior to the nailing operation. Thus, one side edge is provided with a plurality of uniformly vertically-spaced apertures 30 into which the turned lower end 32 of a hanger 34 can be inserted selectively to determine the height at which the board is suspended in the mold. An intermediate part of the hanger passes through an aperture 35 in an end tab 36 of the strap to hold the strap and hanger in their relative positions, while the other end is also turned so that its end engages the mold top edge, to retain the hanger thereon. Once the nailing operation has been completed the hanger can be removed for re-use so that only the straps are lost. In order to facilitate insertion and removal of the hanger's lower end 32 into and out of apertures 30, it is preferred that the apertures be formed in the shape of horizontal slots as shown in FIG. 2 of the drawings. However, making apertures 30 in the form of simple round holes will also work for the purposes of this invention. In the latter case, the aperture 35 in tab 36 is preferably made elongate as shown in FIG. 3 so as to permit the lower end 32 of the hanger to be moved into or out of apertures 30. It will be noted that in both of these particular embodiments the channel side edges having the apertures 30 are formed somewhat longer than the unapertured other edge.

It is also to be appreciated that the preferred embodiment described and illustrated herein is provided solely for the sake of example and clarity, and should in no way be construed as limiting the scope of the present invention. Thus, certain modifications may be carried out on the preferred embodiment without departing from the essential features of the invention. For example, it is contemplated that one might affix steel strap elements 18 to boards 14 and 16 by means other than staples 20, e.g., by small nail-like pins. Similarly, one might provide apertures 30 on both side edge elements 22, or one might omit entirely the side edge element which carries no apertures 30. It is also contemplated that one might extend the length of the upper end of hanger 34 so that it reaches to and hangs over the exterior surface of mold 10 rather than stopping on the upper edge of the mold. These and other changes of their type are foreseen as obvious to one skilled in the art and considered to be within the scope of the present invention.

What is claimed is:

1. A method for fastening hot top boards to the top interior of a metal ingot mold comprising:

fastening to one surface of a hot top board at least one elongated metal strap;

positioning the hot top board inside the top end of the mold with said at least one metal strap facing inwards and suspending the hot top board from the top end of the mold by hanger means connected to said at least one metal strap, each metal strap having a channel-shaped transverse cross-section with the base of the channel in contact with said one surface of the board, whereby the channel can constitute a guiding and locating element for a nailing gun; and nailing the hot top board to the mold interior surface by nails driven through the said elongated metal strap.

2. A method according to claim 1, wherein the sides of each channel are inclined inwards toward one another at an angle of between 30° and 60° to the channel base.

3. A method according to claim 1, wherein each strap is fastened to the board by spaced staples.

4. A method according to claim 1, wherein the said nails are driven by means of a long-handled nailing tool held by an operator above the mold, extending down into the mold and engaged in the said channel to ensure driving of the nails through the strap.

5. A method according to claim 1 wherein said at least one metal strap includes a plurality of vertically spaced apertures formed in one side wall of said channel, and said hanger means comprises a hanger element having a first part adapted to be removably secured to said at least one metal strap via one of said vertically spaced apertures, and a second part adapted to engage the top end of said mold for retention thereon.

6. A method according to claim 5 wherein each of said apertures comprises a slot formed in said one side wall of said channel.

7. A method according to claim 5 wherein each of said apertures comprises a hole formed in said one side wall of said channel.

8. A method according to claim 5 wherein said at least one metal strap includes an end tab disposed about the upper end of said strap, said end tab having an opening therein for accommodating an intermediate portion of said hanger element.

9. A hot top board element for lining the top interior of a metal ingot mold comprising a substantially uniformly thick flat board of hot top material having at least one metal strap fastened to one flat surface thereof and constituting an extended metal washer for the reception of nails for fastening the board to the interior wall of a mold, said at least one metal strap is of channel transverse cross-section with the base of the channel in contact with said one surface, whereby the channel can constitute a guiding and locating element for a nailing tool.

10. A hot top board element as claimed in claim 9, wherein the sides of each channel are inclined inwards toward one another at an angle of between 30° and 60° to the channel base.

11. A hot top board element as claimed in claim 9 further including a hanger for suspending the board within the mold, one part of the hanger being removably secured to the strap and another part of the hanger being adapted for engagement with the mold top edge for retention thereon.

12. A hot top board element as claimed in claim 9, wherein each channel strap is fastened to the board by spaced staples.

13. A hot top board element as claimed in claim 11 wherein one side wall of the channel is provided with a plurality of vertically spaced slots, and said hanger is engageable with a selected one of said slots.

14. A hot top board element according to claim 11 wherein one side wall of the channel is provided with a plurality of vertically spaced holes, and said hanger is engageable with a selected one of said holes.

15. A hot top board element according to claim 11 wherein said at least one metal strap includes an end tab disposed about the upper end of said strap, said end tab having an opening therein for accommodating an intermediate portion of said hanger.

16. A hot top board for lining the top interior of a metal ingot mold comprising:

a flat board of hot top material, at least one elongated strap of channel-shaped cross-section fastened to the board with its base in contact with a surface of the board and its sides protruding from said surface, the strap being disposed vertically and having in one vertical side thereof a plurality of longitudinally spaced apertures; and a hanger having an end adapted for selective insertion in one of said apertures and another part thereof engageable with the mold top edge for retention thereon.

17. In combination with a hollow metal ingot mold having a top end edge, a hot top board having first and second flat opposite surfaces and oriented so that said first surface confronts an inside surface of said mold and said second surface faces away from said inside surface, at least one elongated channel shaped strap extending along and secured to said second surface, said strap being penetrable by the shank of a nail having a head so as to constitute an extended metal washer for one or more nails used to fasten said board to said inside surface of said mold, and hanger means for suspending said board from the top end of said mold, said hanger means comprising at least one hanger having one hook-shaped end overlapping and engaged with the top end edge of said mold and an opposite end attached to said strap.

18. A method for fastening hot top boards to the top interior of a metal ingot mold comprising:

fastening to one surface of a hot top board at least one elongated metal strap provided with a plurality of vertically spaced apertures;

positioning the hot top board inside the top end of the mold with said at least one metal strap facing inwards;

suspending the hot top board from the top end of the mold by hanger means which comprises a hanger member having one part removably positioned in a selected one of said apertures and another part thereof engaged with the top end of the mold; and nailing the hot top board to the mold interior surface by nails driven through the said metal strap.

19. A method according to claim 18 including the step of removing said hanger means subsequent to the nailing operation and prior to the pouring of an ingot in the mold.

* * * * *